US005264865A

United States Patent [19]

Shimoda et al.

[11] Patent Number: 5,264,865

[45] Date of Patent: Nov. 23, 1993

[54] INK JET RECORDING METHOD AND APPARATUS UTILIZING TEMPERATURE DEPENDENT, PRE-DISCHARGE, MENISCUS RETRACTION

[75] Inventors: Junji Shimoda, Chigasaki; Sakiko Tanabe, Tokyo; Toshiaki Hirosawa, Hiratsuka, all of Japan

[73] Assignee: Canon Kabushiki Kaisha, Tokyo, Japan

[21] Appl. No.: 825,772

[22] Filed: Jan. 21, 1992

Related U.S. Application Data

[63] Continuation of Ser. No. 430,977, Nov. 1, 1989, abandoned, which is a continuation of Ser. No. 132,895, Dec. 14, 1987, abandoned.

[30] Foreign Application Priority Data

Dec. 17, 1986 [JP] Japan ..... 61-302677

[51] Int. Cl.[5] ..... B41J 2/045

[52] U.S. Cl. ..... 346/1.1; 346/140 R

[58] Field of Search ..... 346/140 R, 1.1

[56] References Cited

U.S. PATENT DOCUMENTS

| | | | |
|---|---|---|---|
| 4,161,670 | 7/1979 | Kern | 310/317 |
| 4,352,114 | 9/1982 | Kyogoku et al. | 346/140 R |
| 4,544,931 | 10/1985 | Watanabe et al. | 346/140 R |
| 4,639,735 | 1/1987 | Yamamoto et al. | 346/1.1 |
| 4,660,056 | 4/1987 | Yokoi | 346/140 R |
| 4,714,935 | 12/1987 | Yamamoto et al. | 346/140 R |
| 4,746,937 | 5/1988 | Luc | 346/140 |
| 4,752,790 | 6/1988 | Scardovi | 346/140 |

FOREIGN PATENT DOCUMENTS

| | | |
|---|---|---|
| 0208484 | 1/1987 | European Pat. Off. . |
| 2329445 | 5/1977 | France . |
| 52-56928 | 5/1977 | Japan . |
| 55-27210 | 2/1980 | Japan . |
| 55-65566 | 5/1980 | Japan . |
| 55-65567 | 5/1980 | Japan . |
| 56-60261 | 5/1981 | Japan . |
| 57-103854 | 6/1982 | Japan . |
| 59-3272 | 1/1984 | Japan . |
| 59-176055 | 10/1984 | Japan . |

*Primary Examiner*—Joseph W. Hartary

*Attorney, Agent, or Firm*—Fitzpatrick, Cella, Harper & Scinto

[57] ABSTRACT

An ink jet recording method of applying, to a piezoelectric element serving as an energy generating member for ink droplet formation and emission, a first voltage pulse for retracting the meniscus in a direction opposite to the emitting direction prior to the ink droplet formation, and a second voltage pulse supplied in succession to the first voltage pulse for emitting an ink droplet. The first voltage pulse is controlled according to the circumferential temperature of the piezoelectric element in action.

11 Claims, 3 Drawing Sheets

INK JET RECORDING METHOD AND APPARATUS UTILIZING TEMPERATURE DEPENDENT, PRE-DISCHARGE, MENISCUS RETRACTION

This application is a continuation of application Ser. No. 07/430,977 filed Nov. 1, 1989, now abandoned, which in turn is a continuation of application Ser. No. 07/132,895 filed Dec. 14, 1987, now abandoned.

BACKGROUND OF THE INVENTION

1. Field of the Invention

The present invention relates to a method for controlling the recording operation of an ink jet recording apparatus, and more particularly a recording method of applying, in driving a piezoelectric element, a first voltage pulse for retracting the meniscus before the ink droplet formation in a direction opposite to that of the ink droplet emission, and a second voltage pulse for causing ink droplet emission, and an ink jet recording apparatus utilizing said recording method.

2. Related Background Art

In an ink jet recording apparatus, ink is supplied to a recording head, and emission energy generating means provided in said recording head is activated according to the information to be recorded thereby emitting liquid ink from an ink orifice toward a recording medium and forming a record on said medium by means of the emitted ink.

For said energy generating means for forming ink droplet, it is already known that a piezoelectric element for electromechanical conversion or a heater for electrothermal conversion can be generally employed.

For driving an ink jet recording apparatus utilizing a piezoelectric element for the energy generating means, there is already proposed, in the Japanese Patent Publication (examined) No. 3272/1984, a method of applying, to said piezoelectric element, a first voltage pulse for retracting the meniscus in the ink emitting orifice, in a direction opposite to the direction of emission prior to the ink droplet formation, and a second voltage pulse for forming and emitting an ink droplet in succession to said first voltage pulse.

In such an ink jet recording method, it is intended to obtain smaller ink droplets of a precise size and a higher emission speed by applying, to the piezoelectric element, a first voltage pulse to retract the meniscus in the emission orifice prior to the ink droplet formation, and a second voltage pulse in succession.

As the ink emission is conducted by the second voltage pulse while the meniscus is retracted by the application of the first voltage pulse, the amount of ink emission is reduced in comparison with the absence of the first voltage pulse. Also the emission speed increases due to the presence of a meniscus advancing force, caused by the surface tension of the meniscus in the retracted state.

It is therefore possible to obtain smaller ink droplets, thereby forming recording dots with a higher density and a higher precision, by applying a voltage pulse for retracting the meniscus before applying a voltage pulse for ink droplet emission. It is also rendered possible to reduce the ink coagulation at the orifice since a recording head with a relatively large orifice size can be employed.

In addition the higher ink emission speed improves the positional precision of record dots on the recording medium.

However, in such ink jet recording apparatus, the performance of the piezoelectric element and the physical properties of the ink are affected by the circumferential temperature.

In general the piezoelectric element shows a larger displacement for the application of a given voltage, at a higher temperature. On the other hand, the ink viscosity becomes lower at a higher temperature.

Consequently if a fixed voltage pulse is given as the first voltage pulse for meniscus retraction regardless of the temperature, the amount of meniscus retraction becomes larger or smaller than a desired value respectively at a higher or lower temperature.

If such phenomenon is large enough, at a higher temperature, a large meniscus retraction may eventually result in a bubble suction from the outside, leading to unstable ink emission or lack of emission, while, at a lower temperature, a reduced meniscus retraction loses the advantages such as formation of smaller ink droplets and a higher emission speed.

Also the Japanese Patent Publications (unexamined) Nos. 27210/1980, 65566/1980, 65567/1980 and 60261/1981 disclose modification of the driving conditions of the piezoelectric element according to the temperature. However these proposed methods do not employ the first and second pulses explained above, and do not have, therefore, the advantages of the recording method utilizing two pulses.

Consequently the above-mentioned drawbacks cannot be resolved completely by merely modifying the emission pulse in these methods in which an ink emission is made by an emission pulse.

SUMMARY OF THE INVENTION

An object of the present invention is to provide an ink jet recording method capable of resolving the above-mentioned drawbacks of the prior technology and obtaining a constant amount of meniscus retraction by the application of a first pulse for meniscus retraction even at various circumferential temperatures, thus achieving stable ink emission at high or low temperature and realizing a distinct effect of meniscus retraction.

Another object of the present invention is to provide an ink jet recording method for applying, to a piezoelectric element serving as the energy generating member for ink droplet formation, a first voltage pulse for retracting the meniscus before the ink droplet formation in a direction opposite to the direction of ink emission, and a second voltage pulse in succession for ink droplet emission, wherein said first voltage pulse is regulated according to the circumferential temperature of said piezoelectric element.

Still another object of the present invention is to provide an ink jet recording apparatus comprising an ink jet recording head provided with a piezoelectric element as an energy generating member for ink emission; drive control means for generating, in succession a first voltage pulse for displacing said piezoelectric element in a direction opposite to the direction of ink emission and a second voltage pulse for displacing said piezoelectric element in said direction of emission; and temperature detection means for supplying said drive control means with temperature information, wherein said drive control means is adapted to control said first voltage pulse in response to said temperature information.

DETAILED DESCRIPTION OF THE PREFERRED EMBODIMENTS

Now the present invention will be clarified in detail by embodiments thereof shown in the attached drawings.

Figure 5:
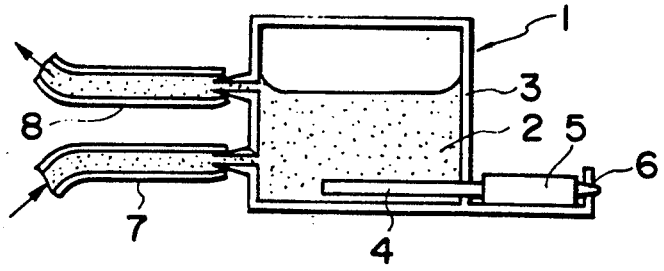
FIG. 5 is a longitudinal cross-sectional view of a recording head of an ink jet recording apparatus adapted for the method of the present invention.

FIG. 5 is a longitudinal cross-sectional view of an example of a recording head 1 of an ink jet recording apparatus adapted for utilizing the method of the present invention.

In FIG. 5, the recording head 1 has a sub tank 3 capable of storing ink 2 to a predetermined level, to which hermetically connected are a plurality (for example 128) of liquid paths 4.

The externally exposed portion of each liquid path 4 is surrounded by a cylindrical piezoelectric element 5, maintained in place for example by adhesion, and the outer end of each liquid path 4 is tapered to form a nozzle 6, thus constituting an ink emission orifice at the end portion.

To said sub tank 3 there are connected an ink supply tube 7 for ink supply from an unrepresented main tank, and an ink suction tube 8 connected to an unrepresented suction pump for elevating the ink level in the sub tank to a predetermined range.

Figure 1:
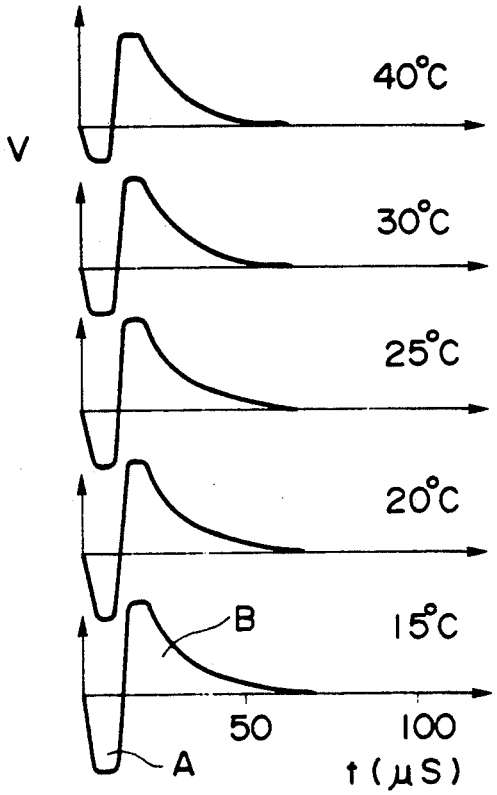
FIG. 1 is a chart showing the wave form of the voltage pulse for driving the piezoelectric element at various temperatures in the ink jet recording method of the present invention.

FIG. 1 shows the wave form of a voltage pulse for driving the piezoelectric element 5 at various temperatures in exercising the ink jet recording method of the present invention.

The ink jet recording method of the present invention is featured, in a method employing a peizoelectric element as the energy generating member for ink droplet formation and applying, for driving said peizoelectric element, a first voltage pulse for retracting the meniscus before ink droplet formation in a direction opposite to the direction of ink emission (pulse A in FIG. 1) and a second voltage pulse (pulse B in FIG. 1) for ink droplet emission in succession to said first voltage pulse, by the control of the wave form of said first voltage pulse according to the circumferential temperature of said piezoelectric element at use.

More specifically, as shown in FIG. 1, the first voltage pulse A for meniscus retraction before the ink droplet emission is opposite to the polarization direction of the piezoelectric element, is supplied in such a direction as to increase the volume of the pressure chamber (liquid path 4). The amplitude of said pulse was increased as the circumferential temperature become lower.

FIG. 1 shows the wave forms of the voltage pulse at 40°, 30°, 25°, 20° and 15° wherein the ordinate indicates the voltage in volts, while the abscissa indicates the time t in microseconds.

The temperature-dependent control of the voltage or amplitude of the first voltage pulse A maintains a constant meniscus retraction despite the increase in ink viscosity and the decrease in the displacement of the piezoelectric element 5 at a lower temperature.

Figure 2:
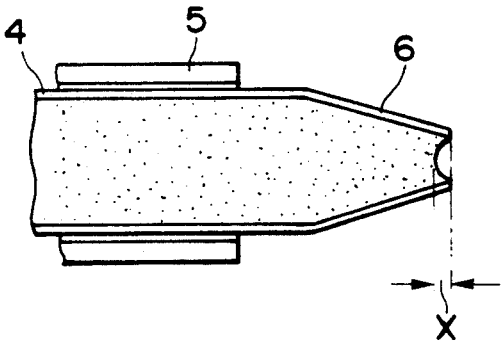
FIG. 2 is a partial longitudinal cross-sectional view showing the meniscus retraction at the ink orifice.

FIG. 2 shows a state of a retraction X, in a direction opposite to the emitting direction, of the meniscus in the ink orifice at the end of the nozzle 6.

On the other hand, the second voltage pulse B for ink droplet emission is applied in succession to the first voltage pulse A as shown in FIG. 1.

Said second voltage pulse B is directed same as the polarization direction of the piezoelectric element 5, thus serving to decrease the volume of the pressure chamber, constituted by a portion of the liquid path 4 surrounded by the piezoelectric element 5.

Figure 3:
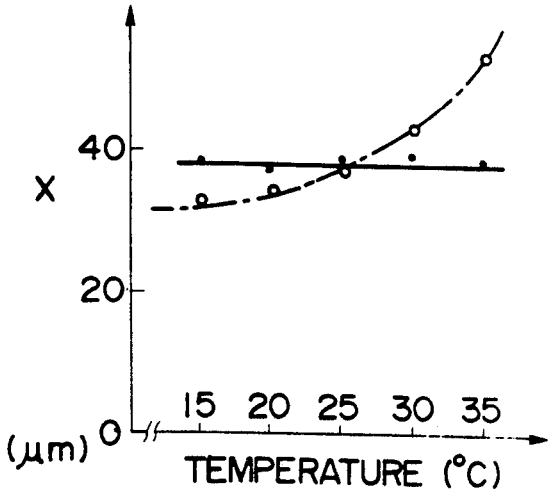
FIG. 3 is a chart showing the amount of meniscus retraction as a function of temperature.

FIG. 3 shows the temperature-dependent change in the amount of meniscus retraction caused by the first voltage pulse A, wherein the ordinate indicates the amount of said retraction in micrometers while the abscissa indicates the temperature (°C).

In FIG. 3, a chain line indicates the temperature-dependent change of the amount of meniscus retraction when the first voltage pulse A is not controlled according to the temperature, as in the conventional technology, and a solid line indicates the same in case said first voltage pulse A is controlled in response to the temperature, according to the method of the present invention.

As shown by the solid line in FIG. 3, the temperature-dependent control of the first voltage pulse A maintains a substantially constant meniscus retraction over a temperature range from 15° C. to 40° C.

On the other hand, if the first voltage pulse was maintained constant at various temperatures without the temperature-dependent control, the amount of meniscus retraction increased with the circumferential temperature, due to the changes in ink viscosity and in the displacement of the piezoelectric element at different temperatures.

Figure 4:
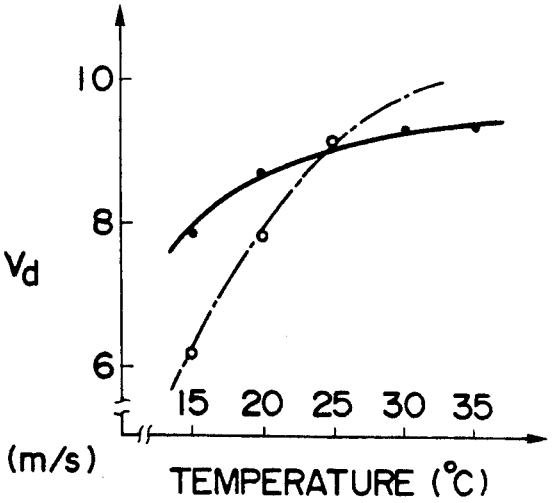
FIG. 4 is a chart showing the ink emission speed as a function of temperature.

FIG. 4 shows the temperature-dependent change in the emission speed of the ink droplet emitted by the first voltage pulse A, wherein the ordinate indicates the emission speed $v_d$ (m/s) while the abscissa indicates the temperature (°C.).

In FIG. 4, a chain line shows the temperature-dependent characteristic of the ink emission speed in the conventional technology in which the first voltage pulse is not controlled in response to the temperature, while a solid line indicates the corresponding characteristic when the amplitude of the first voltage pulse is controlled in response to the temperature according to the method of the present invention.

As will be apparent from FIG. 4, the temperature-dependent control of the first voltage pulse A according to the present invention provides relatively stable ink emission speed at different temperatures, but the first pulse A without temperature dependent control provides a rapid change in the ink emission speed, depending on the circumferential temperature, eventually resulting in unstable emission.

Besides, the first voltage pulse A without the temperature-dependent control results in a larger meniscus retraction at a higher temperature as shown in FIG. 3, eventually giving rise to bubble suction from the ink orifice and to unstable ink emission.

In addition to the temperature-dependent control of the first voltage pulse A, there may be employed a temperature-dependent control of the wave form of the second voltage pulse B for ink emission in order to further stabilize the ink emission speed in comparison with that shown in FIG. 4. Also it was rendered possible to stabilize the size of the ink droplet at different temperatures.

Figure 6:
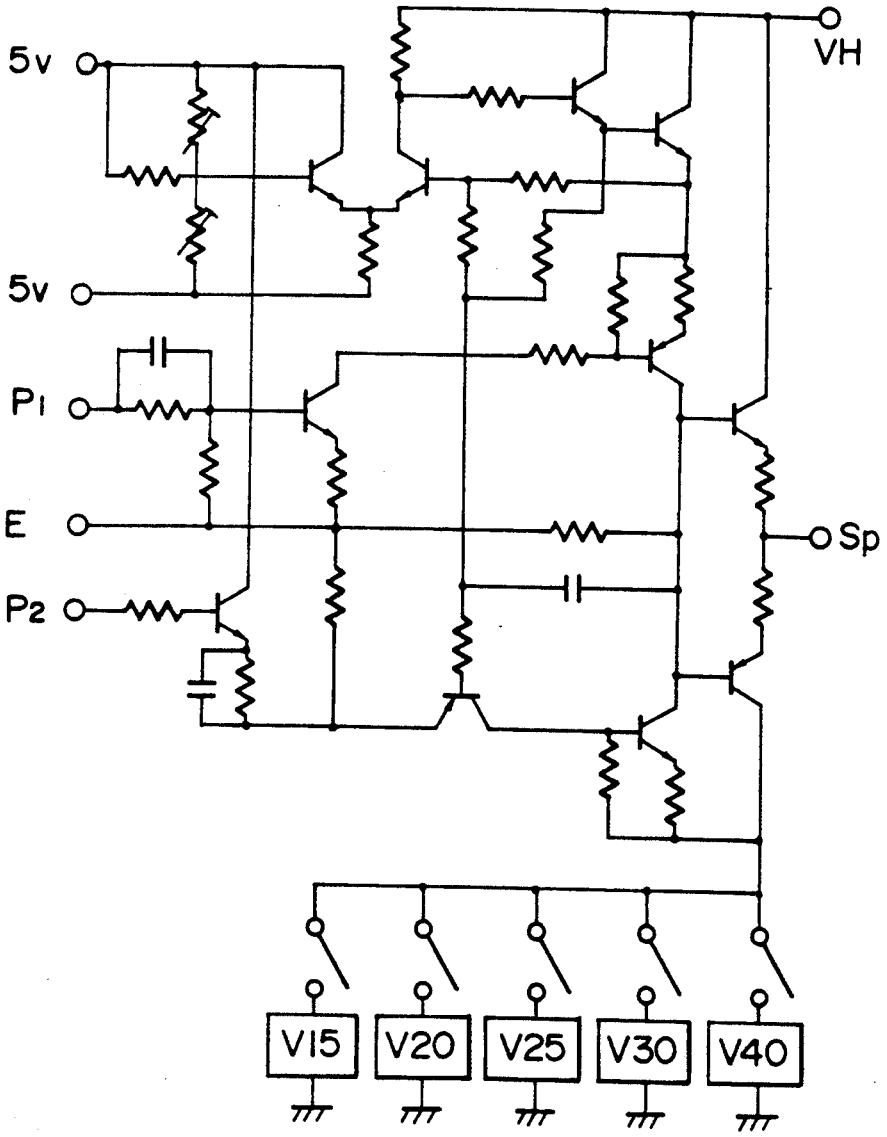
FIG. 6 is a circuit diagram showing an example of a piezoelectric element driving circuit adapted for use in the method of the present invention.

FIG. 6 shows an example of a piezoelectric element driving circuit for executing the ink jet recording method of the present invention.

In FIG. 6, trigger pulses P1 and P2, for generating the first and second voltage pulses A, B are generated at appropriate timings from an unrepresented control unit, according to the information to be recorded.

In FIG. 6, VH indicates a power source voltage for the second voltage pulse B, and Sp indicates the output of the piezoelectric element.

The voltage of the first voltage pulse A is selected at an optimum value corresponding to the circumferential temperature, in response to the information from unrepresented temperature detecting means, within a range from V15 (value appropriate at 15° C.) to V40 (value appropriate at 40° C.).

In the above-explained embodiment, the wave form (voltage) of a first voltage pulse A, for retracting the meniscus at the ink orifice immediately prior to the emission of a recording ink droplet, is controlled according to the circumferential temperature in such a manner as to obtain a constant meniscus retraction at different temperatures, thereby stabilizing the ink emission at high temperature and reducing the temperature-dependent change in the ink emission speed, thus achieving recording of stable and high quality.

Figure 7:
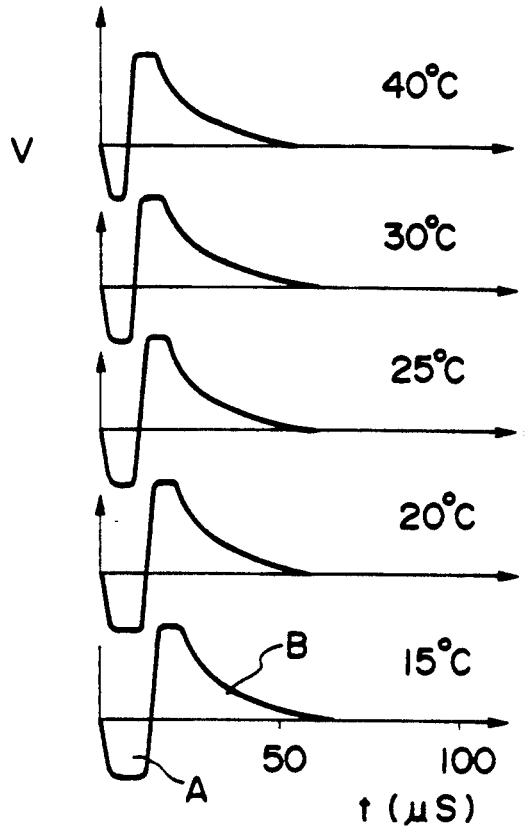
FIG. 7 is a chart showing the wave form of a voltage pulse for driving the piezoelectric element, constituting another embodiment of the present invention, at various temperatures.

FIG. 7 shows the wave forms of a voltage pulse for driving the piezoelectric element 5 at different temperatures in another embodiment.

In FIG. 7, the first voltage pulse A for meniscus retraction, applied prior to the ink droplet emission, is opposite to the polarization direction of the piezoelectric element 5, serving to increase the volume of the pressure chamber, composed of a part of the liquid path 4 surrounded by the piezoelectric element 5.

In the present embodiment, the duration of said first voltage pulse A was so regulated, according to the circumferential temperature, that said duration increased at a lower temperature. In this manner the temperature-dependent control of the wave form of the first voltage pulse A was conducted by a change in the pulse duration.

Similar to the amplitude control shown in FIG. 1, the temperature-dependent control of the wave form of the present embodiment is capable of maintaining a constant meniscus retraction by the first voltage pulse A despite the increase in ink viscosity and the decrease in the displacement of the piezoelectric element at a lower temperature.

Other structures and functions of the embodiment shown in FIG. 7 are substantially the same as those of the foregoing embodiment shown in FIGS. 1 to 6 so that similar advantages can be obtained also with the embodiment shown in FIG. 7.

The recording method of the present invention is applicable not only to the recording head explained above but also to any recording head utilizing an electromechanical energy conversion member such as a piezoelectric element for the means for generating emission energy.

In the foregoing description the driving voltage of the first pulse is varied in a certain number of levels, but the present invention is naturally not limited to such digital control. For example the voltage of the first pulse may be varied in analog manner according to the circumferential temperature.

Furthermore, according to the present invention, the duration of the first pulse may be varied in digital or analog manner, as in the amplitude.

Furthermore, it is naturally possible, according to the present invention, to control the driving voltage and the pulse duration thereof according to the circumferential temperature.

Figure 8:
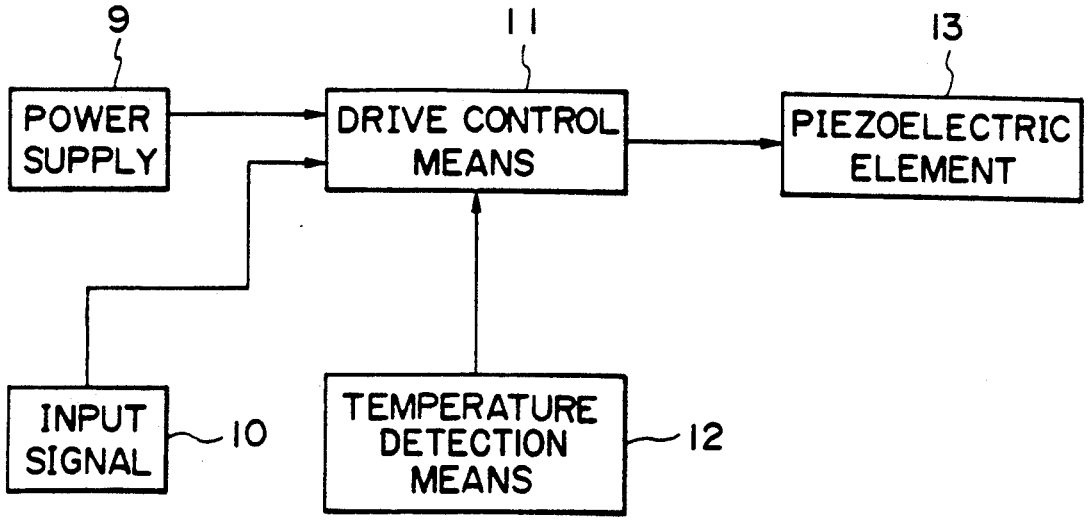
FIG. 8 is a block diagram of an apparatus adapted for utilization of the method of the present invention.

FIG. 8 shows an example of block diagram of an ink jet recording apparatus capable of realizing the recording method of the present invention, drive control means 11, connected to a power supply 9 and receiving an input image signal 10, supplies the piezoelectric element 13 of the recording head with the output signal. The recording method of the present invention is achieved by supplying temperature information from temperature detecting means 12 to the drive control means 11 and accordingly varying the driving pulse.

Said temperature detecting means may be composed of an already known device such as a thermistor.

The present invention is not limited to the foregoing embodiments but is subject to various modifications within the scope and spirit of the appended claims.

As detailedly explained in the foregoing, the present invention allows the temperature-dependent change of meniscus retraction to be reduced, thereby enabling an ink jet recording method capable of exact and stable ink emission at high and low temperatures.

We claim:

1. A liquid jet recording method for discharging liquid from a recording head having an orifice at which the liquid forms a meniscus prior to discharge and a piezoelectric element for displacing when a voltage is applied thereto, thereby generating energy for displacing the meniscus in a discharge direction and discharging liquid from the orifice, the method comprising:

detecting the ambient temperature;

generating a waveform with two voltage pulses applied in succession to the piezoelectric element, said two pulses comprising (i) a first pulse for retracting the meniscus in the orifice in a direction opposite to the discharge direction prior to the liquid being discharged, wherein said first pulse is controlled in accordance with the ambient temperature to reduce changes in the amount of meniscus retraction caused by changes in ambient temperature, and (ii) a second pulse for displacing the piezoelectric element and the meniscus in the discharge direction for discharging the liquid, whereby relatively stable liquid emission speed is provided at different ambient temperatures.

2. An ink jet recording method according to claim 1, wherein the amplitude of said first voltage pulse is varied in accordance with the ambient temperature.

3. An ink jet recording method according to claim 2, wherein the amplitude of said first voltage pulse is varied in steps in accordance with the ambient temperature.

4. An ink jet recording method according to claim 1, wherein the pulse-width of said first voltage pulse is varied in accordance with the ambient temperature.

5. An ink jet recording method according to claim 4, wherein the pulse-width of said first voltage pulse is varied in steps in accordance with the ambient temperature.

6. An ink jet recording method according to claim 1, wherein said second voltage pulse is varied in accordance with the ambient temperature.

7. An ink jet recording method according to claim 1, wherein the amplitude and pulse width of said first voltage pulse are varied in accordance with the ambient temperature.

8. A liquid jet recording apparatus comprising:

a liquid jet recording head having an orifice for discharging liquid, wherein the liquid forms a meniscus at said orifice prior to discharge, and a piezoelectric element for displacing when a voltage is applied thereto, thereby generating energy for displacing the meniscus in a discharge direction and discharging liquid from said orifice;

temperature detecting means for detecting the ambient temperature; and a driving signal generator, connected to said temperature detecting means and to said piezoelectric element, for generating a waveform with two voltage pulses for application in succession to said piezoelectric element, said two voltage pulses comprising (i) a first pulse for displacing said piezoelectric element and retracting the meniscus in a direction opposite to the discharge direction, wherein said first pulse is controlled in accordance with the detected ambient temperature to reduce changes in the amount of meniscus retraction caused by changes in ambient temperature, and (ii) a second pulse for displacing said piezoelectric element and said meniscus in the discharge direction for liquid discharge, whereby relatively stable liquid emission speed is provided at different ambient temperatures.

9. An ink jet recording apparatus according to claim 8, wherein the amplitude of said first voltage pulse is varied in accordance with the ambient temperature.

10. An ink jet recording apparatus according to claim 8, wherein the pulse-width of said first voltage pulse is varied in accordance with the ambient temperature.

11. An ink jet recording apparatus according to claim 8, wherein the amplitude and pulse-width of said second voltage pulse are varied in accordance with the ambient temperature.

* * * * *

UNITED STATES PATENT AND TRADEMARK OFFICE

CERTIFICATE OF CORRECTION

PATENT NO. : 5,264,865

DATED : November 23, 1993

INVENTOR(S) : JUNJI SHIMODA, ET AL.

It is certified that error appears in the above-identified patent and that said Letters Patent is hereby corrected as shown below:

COLUMN 1

Line 41, "orifice," should read --orifice--.

COLUMN 3

Line 58, "peizoelectric" should read --piezoelectric--.
Line 60, "peizoelectric" should read --piezoelectric--.

COLUMN 4

Line 7, "become" should read --became--.

COLUMN 6

Line 66, "An ink" should read --A liquid--.

COLUMN 7

Line 1, "An ink" should read --A liquid--.
Line 5, "An ink" should read --A liquid--.
Line 8, "An ink" should read --A liquid--.
Line 12, "An ink" should read --A liquid--.
Line 15, "An ink" should read --A liquid--.

UNITED STATES PATENT AND TRADEMARK OFFICE

CERTIFICATE OF CORRECTION

PATENT NO. : 5,264,865

DATED : November 23, 1993

INVENTOR(S) : JUNJI SHIMODA, ET AL.

It is certified that error appears in the above-identified patent and that said Letters Patent is hereby corrected as shown below:

COLUMN 8

Line 18, "An ink" should read --A liquid--.
Line 21, "An ink" should read --A liquid--.
Line 24, "An ink" should read --A liquid--.

Signed and Sealed this

Twentieth Day of September, 1994

Bruce Lehman

*Attest:*

BRUCE LEHMAN

*Attesting Officer*

*Commissioner of Patents and Trademarks*